US005950286A

United States Patent [19]

Failing et al.

[11] Patent Number: 5,950,286

[45] Date of Patent: Sep. 14, 1999

[54] SEPARABLE BOTTOM STOP ASSEMBLY OF SLIDE FASTENER

[75] Inventors: Norbert Failing, Buseck, Germany; Hung Vo The, Mareq-En-Baroeul, France

[73] Assignee: YKK Corporation, Tokyo, Japan

[21] Appl. No.: 09/122,070

[22] Filed: Jul. 24, 1998

[30] Foreign Application Priority Data

Jul. 25, 1997 [GB] United Kingdom ..... 9715833

[51] Int. Cl.[6] ..... A44B 19/00

[52] U.S. Cl. ..... 24/433; 24/434

[58] Field of Search ..... 24/433, 432, 400, 24/370, 381, 388, 340

[56] References Cited

U.S. PATENT DOCUMENTS

| | | | |
|---|---|---|---|
| 4,571,784 | 2/1986 | Okazaki | 24/433 |
| 4,571,785 | 2/1986 | Akashi | 24/433 |
| 5,388,312 | 2/1995 | Fudaki | 25/433 X |
| 5,412,849 | 5/1995 | Fudaki | 24/388 |
| 5,446,949 | 9/1995 | Fudaki | 24/433 |
| 5,586,370 | 12/1996 | Fudaki . | |
| 5,638,585 | 6/1997 | Mizuno | 24/433 |
| 5,755,014 | 5/1998 | Yamaguci et al. | 24/433 |
| 5,836,059 | 11/1998 | Chung | 24/432 |

FOREIGN PATENT DOCUMENTS 0 704 177 A1 9/1995 European Pat. Off. .

*Primary Examiner*—James R. Brittain
*Assistant Examiner*—Robert J. Sandy
*Attorney, Agent, or Firm*—Hill & Simpson

[57] ABSTRACT

In a bottom stop assembly for a separable slide fastener, an open box has a first channel for receiving a box pin firmly attached on an end of a stringer. The open box has front and rear walls between which a web intervenes at their intermediate portions. Right and left flanges define with the web and the front and rear walls the first and a second channel for receiving an the box pin and an insert pin firmly attached on the lower ends of the other stringer. The channel on the box pin insertion side has projections on the flanges extending inwardly, the projections urging the box pin against the web. Upper and lower engaging surfaces formed by a cut-out embrace the web from up and down to limit axial movement of the box pin in the open box. A bulge on the lower end of the box pin bears against the flanges presses the projections to urge the box pin against the web. With these arrangements, any movement of the box pin inside the box is completely restricted.

16 Claims, 2 Drawing Sheets

SEPARABLE BOTTOM STOP ASSEMBLY OF SLIDE FASTENER

BACKGROUND OF THE INVENTION

1. Field of the Invention

The present invention relates to a slide fastener, and in particular to a bottom stop assembly of a slide fastener with a separable bottom stop assembly.

2. Description of the Related Art

A separable slide fastener comprises two stringers which are completely separable. One of the stringers carries the slider permanently, and has at its bottom end a bottom end stop which incorporates an open box. The open box receives the bottom end stop of the other stringer, when the user closes the fastener.

Typically the two stringers are sewn to each side edge of an opening of an open and close article such as a bag, a garment, or the like. The open box is relatively bulky and can interfere with the sewing process. In order to avoid this problem, there are various open box designs in which the box can be firmly attached as being snap fitted onto a box pin fixed to the stringer, after the stringer has been sewn in an appropriate place of the above-described open and close article.

In DE-PS-626241, saw like teeth on the box pin engage in cooperating holes provided in the front and back walls of the box. Such a fixing impairs the appearance of the box as the teeth are exposed from the cooperating holes.

U.S. Pat. No. 4,112,553 describes an open box which has saw like teeth on the internal faces of the front and back wall of the box. The bottom end stop has grooves into which the teeth engage, preventing subsequent removal of the box. Thus the external front and back face of the box can have a plain, neat appearance.

JP-UM-55-93308 shows an arrangement in which a formation on the lower end of the box pin projects through a through-hole in the bottom wall of the box to secure the parts together.

JP-A-37-14329 shows an arrangement in which a tongue extends in from a side wall of the box to engage in a recess in the bottom stop.

Problems with these snap-fit designs are to provide a fixing which is not visible to the user so that it does not impair the visual impact of the open box, and also to provide a fixing which resists any movement of the box relative to the box pin since the box can be subject to quite strong lateral forces when the other end stop is inserted into the box.

JP-A-6-46906 shows a fixing in which the outer edge of the lower end of the bottom stop has a shoulder on its outside edge, which engages under a resilient leaf in the box.

JP-UM-6-38624 shows a fixing in which the lower end of the bottom stop is bifurcated. Shoulders on each outer side of the legs at the lower end engage under respective lips in the open box. The legs are urged toward each other as they are inserted into the box. These designs ameliorate some of the above-mentioned difficulties but still allow for axial movement of the box pin in the box.

SUMMARY OF THE INVENTION

An object of the invention is to provide a bottom end stop assembly of a separable slide fastener, which is simple in structure and can completely prevent the axial movement of the box pin inside the box, in which other components are not exposed on its outer surface and which does not have an excessive thickness.

A first aspect of the invention provides a bottom stop assembly for a separable slide fastener, the assembly comprising a box pin mounted on an end of a stringer, and an open box which is firmly engaged with the box pin by snapfitting and, in use, receives the insert pin attached to an end of the other stringer. The assembly is characterized by that the open box includes front and rear walls, a web means intervening between the front and rear walls at portions intermediate of side edges, the web means having upper and lower engaging surfaces, a first channel defined by the front and rear walls and the web means for receiving the box pin and a second channel defined by the front and rear walls and the web means for receiving the insert pin. The box pin has limiting means to be engaged with the web means for limiting axial movement of the box pin relative to the web means. With these features, the axial movement of the box pin relative to the web means is limited due to the limiting means so that the box pin can be reliably held in the open box even when an external force is exerted.

Preferably, the web means joins the front and rear walls in the middle of opposite ends of the walls, and the assembly further includes flanges extending from the opposite ends of the front and rear walls toward respective confronting walls and the flanges defining the first channel for receiving the box pin have urging means to urge the box pin to engage with the web means.

With this arrangement, when the box pin is inserted in the first channel of the open box, the box pin and the flanges urge each other to resiliently deform the flanges which allows the box pin to be inserted. Simultaneously, the box pin is always urged by the urging means toward the web means, and when the box pin is completely inserted, the limiting means of the box pin engage with the web means to prevent the axial movement of the box pin. Thus, once the box pin is inserted into the first channel of the open box, its movement is limited by the limiting means so that the box pin can not be removed out of the box. Outer surfaces of the front and rear walls of the box are flat, and any other components do not expose from other parts, thus a neat appearance can be obtained. Moreover, when the extension of the flanges are designed to be minimum for allowing the box pin and the insert pin to be inserted, the open box does not become excessively bulky and the user will not feel uneasy when it is used in clothing.

In this invention, it is preferable that the urging means includes rib-shaped projections formed on the flanges for bearing the box pin. Further preferably, the flanges are thinned in order to flex as the box pin is inserted into the channel. Still preferably, the flanges are thicker towards the bottom of the first channel. With these features, the box pin is easily inserted into the first channel of the box, and the flanges are thicker at portions which contacts the box pin when the box pin of the box engage with the web means to limit its axial movement, so that the flanges do not deform excessively and the box pin can be held in the box stably even when the external force is exerted.

More specifically, the box pin has a cut-out at a position adequate for engagement with the web means, for embracing the web means from up and down. The cut-out serves as the limiting means.

Further preferably, the box pin has such a shape that the box pin abuts the flanges at a region below the lower engaging surface of the web means when the box pin is positioned fully in the first channel. Due to this shape, the box pin forcibly abuts the flanges which are thick and rigid near the lower ends of the box pin so as to realize the firm attachment.

And preferably, an inner side surface of the cut-out is flat against the side surface of the web means near an upper region thereof. In combination with the above-described shape of the box pin, the insertion posture of the box pin is secured.

According to the second aspect of the invention, there provided a separable bottom stop assembly for a separable slide fastener comprising a box pin mounted on an end of a stringer, and an open box which is firmly engaged with the box pin by snap-fitting and, in use, receives the insert pin firmly attached to an end of the other stringer. The assembly is characterized by that the open box includes front and rear walls, web means joining the front and rear walls at portions intermediate of opposite ends of side edges, the web means having upper and lower engaging surfaces, flanges on the side edges and directed towards the respective flanges of the other walls, a first channel defined by the front and rear walls, the web means and the flanges for receiving the box pin, and a second channel defined by the front and rear walls, the web means and the flanges for receiving the insert pin. The flanges are spaced apart to allow tapes of the stringers to pass through, and projections are provided on the flanges defining the first channel. The box pin has on a side surface facing the web means upper and lower engaging surfaces for engaging with upper and lower engaging surfaces of the web means so as to prevent axial movement of the box pin in the first channel, and the box pin is so shaped that a side surface facing the flanges bears against the projections projecting from the flanges at a region below the lower engaging surface, and a side surface facing the web means is brought into tight contact with the web means at a region near the upper engaging surface.

In this second aspect, the differences from the first aspect are that the web means has the upper and lower engaging surfaces, that the confronting flanges are spaced apart to receive the tape of the stringer, that the projections are formed on the flanges which define the first channel, that the upper and lower engaging surfaces are provided on the side surface of box pin which confronting the web means to engage with the upper and lower engaging surfaces of the web means to limit the axial movement of the box pin in the first channel, and that the side surface facing the flanges bears against the projections projecting from the flanges at a region below the lower engaging surface. Particularly, due to the projections, the flanges can be made to be thin so as to secure flexibility of the flanges at the time of insertion of the box pin.

Other preferred features and advantages of the invention will be apparent from the following description.

PREFERRED EMBODIMENTS OF THE INVENTION

Typical embodiments of the invention will be further described with reference to the accompanying drawings. The illustrated example shows an attachment structure of a separable bottom stop assembly for an ordinary slide fastener. However, it is apparent that this invention can be applied to a concealed slide fastener.

Figure 1:
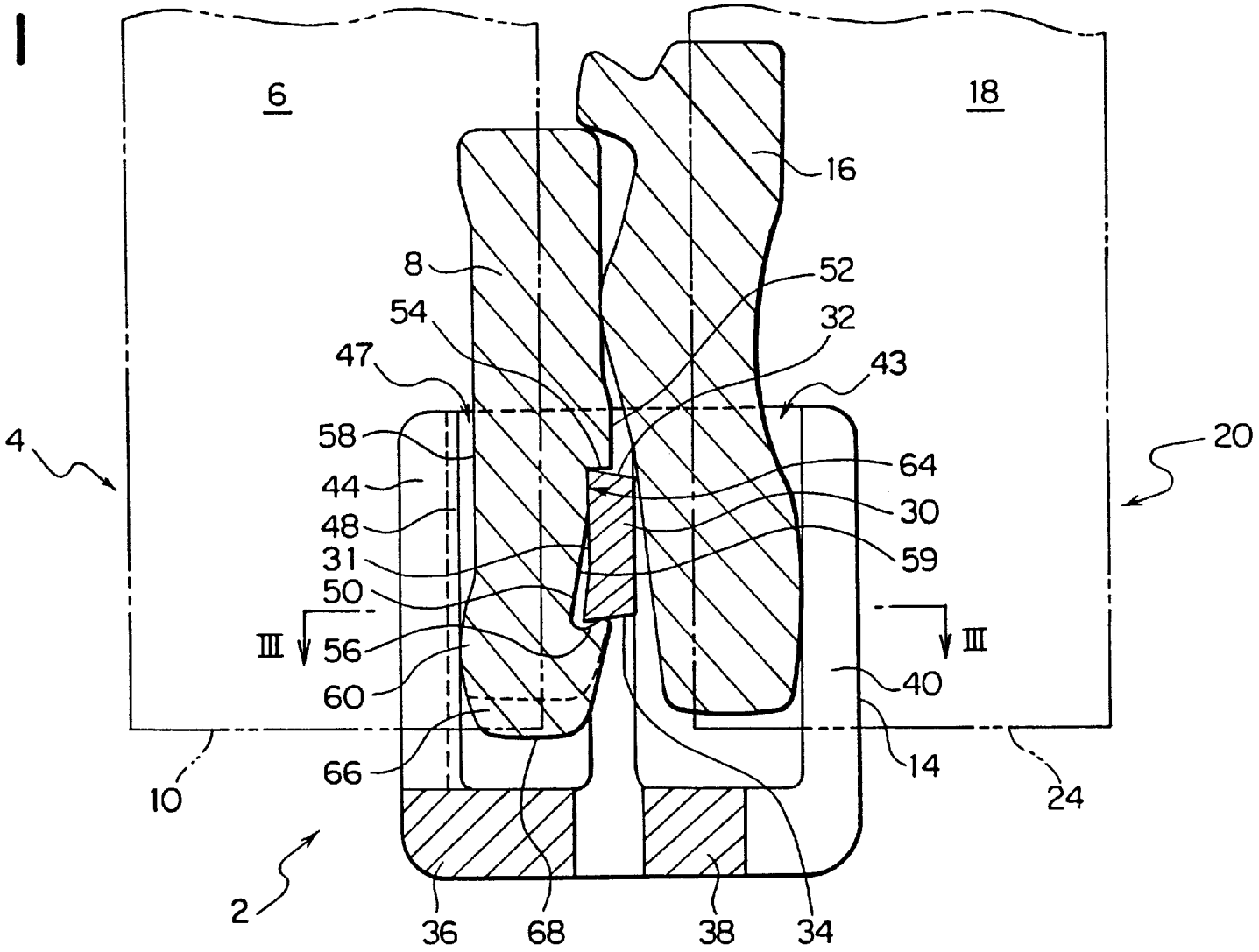
FIG. 1 is a cross-sectional view along line II—II of FIG. 2, showing a separable bottom stop assembly for a separable slide fastener, according to a typical embodiment of the invention.
Figure 2:
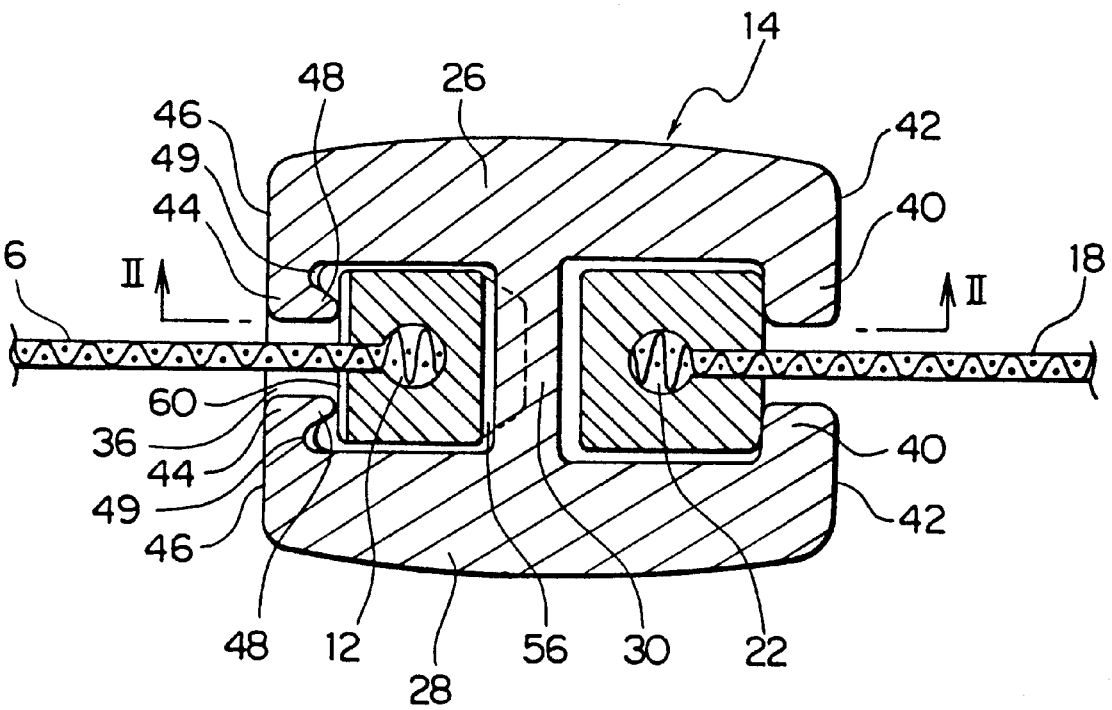
FIG. 2 is a cross-sectional view along line III—III of FIG. 1.

FIG. 1 is a cross-sectional view along line II—II of FIG. 2, showing an lower end of a slide fastener, illustrating a separable bottom stop assembly. FIG. 2 is a cross-sectional view along line III—III of FIG. 1. In these views, a bottom stop assembly 2 of the separable slide fastener is shown.

The slide fastener with the bottom stop assembly comprises a first stringer 4 having a box pin 8 secured on the bottom end 10 of a tape 6 around a beaded edge 12 formed at the tape edge. An open box 14 is firmly engaged with the box pin 8 by snap-fitting, as will be described more fully hereinafter. An insert pin 16 is secured on a tape 18 of a second stringer 20 around a beaded edge 22 at a bottom end 24 thereof. The bottom stop 16 is removably slid into the open box 14 when closing the slide fastener by coupling fastener elements of the first and second stringers 4, 20.

The box pin 8 and the bottom stop 16 are formed of thermoplastic synthetic resin material and are inset molded onto the tapes 6, 18, respectively. The open box 14 is injection molded of plastic synthetic resin material.

The construction thus far described is well known in the art. The present invention is concerned with the construction of the box pin 8 and the open box 14 to realize a secure fitting between the box pin 8 and the open box 14.

The open box 14 has front and rear walls 26, 28 joined by an internal web 30 at an intermediate portion between the right and left ends of the front and rear walls 26, 28. The internal web 30 has upper and lower engaging surfaces 32, 34.

The walls 26, 28 are also joined at their lower ends by bottom webs 36, 38. The webs 36, 38 are spaced apart right and left to facilitate molding of the internal web 30.

Flanges 44 are provided on the side edges 46 of the front and rear walls 26, 28 facing each other and define with the walls 26, 28 and web 30 a first channel 47 for receiving the box pin 8. The flanges 44 extending toward each other from the front and rear walls 26, 28 are spaced apart to allow the tape 6 to pass between them. Grooves 49 are formed longitudinally in the flanges 44 at the internal corner with the walls 26, 28 so as to form rib-shaped projections 48 on the flanges 44 which project into the first channel to serve as urging means. The grooves 49 are shallower towards the bottom of the channel 47, so that the flanges 44 are thicker in this bottom region and so more resistant towards deformation of the flanges 44 at the bottom of the first channel 47. The face 31 of the internal web 30 which faces into the first channel 47 gradually bulges outward at its lower end.

On the other hand, Flanges 40 are similarly provided on the side edges 42 opposite to the first channel 47 of the front and rear walls 26, 28 and define with the walls 26, 28 and the internal web 30 a second channel 43 for receiving the insert pin 16. The flanges 40 are spaced apart to allow the tape 18 to pass between them.

As seen in FIG. 2, the box pin 8 is of generally rectangular cross-section. Referring to FIG. 1, a cut-out 50 in an inner side surface 52 of the box pin 8 facing the internal web 30 serves to define at its top and bottom ends, upper and lower engaging surfaces 54, 56 which serve as limit means as being snugly engaged with the upper and lower engaging surfaces 32, 34 of the internal web 30.

The outer side surface 58 of the box pin 8 facing the flanges 44 of the open box 14 has an outward bulge 60 bulging toward the flanges 44 at a region below the level of the lower engaging surface 56. The bulge 60 bears against the rib-shaped projections 48 which thus secure urging of the cut-out 50 to engage firmly with the internal web 30. The inner side surface 59 of the cut-out 50 is flat against the side surface 31 of the internal web 30 at an upper region 64 near the engaging surfaces 32, 54.

The box pin 8 fits closely between the front and rear walls 26, 28 so that rattling between the front and rear walls 26, 28 can be prevented. The bulge 60 and the flat surface of the box pin 8 prevent front and rear and right and left rattling of the box pin 8 so that secure engagement can be realized.

A lower end portion 66 of the box pin 8 is chamfered towards a point to facilitate insertion of the lower end portion 66 into the first channel 47, between its lower end 68 and the internal web 30.

The slide fastener stringer 6, 18 are manufactured in the usual way with the box pin 8 and the insert pin 16 on the opposed tapes 6, 18, and supplied to the garment or bag manufacturer, etc., with the open box 14. The manufacturer sews the stringers in place and then attaches the open box L4 to the box pin 8. The lower end portion 66 of the box pin 8 is inserted into the first channel 47. During this insertion, the box pin 8 deforms the flanges 44 as it is forced between the internal web 30 and the rib-shaped projections 48, until the cut-out 50 engages around the internal web 30.

What is claimed is:

1. A bottom stop assembly for a separable slide fastener, the assembly comprising a box pin mounted on an end of a stringer, and an open box which is firmly engaged with said box pin by snap-fitting and, in use, receives an insert pin attached to an end of another stringer, wherein the open box includes front and rear walls; a web intervening between said front and rear walls at portions intermediate of side edges of said front and rear walls, the web having a generally rectangular shape and uppermost and lowermost sides spaced inwardly from upper and lower ends of said front and rear walls, the uppermost side of the web having an upper engaging surface and the lowermost side of the web having a lower engaging surface; a first channel defined by said front and rear walls and said web which receives the box pin and a second channel defined by said front and rear walls and said web which receives the insert pin, wherein said box pin has a movement limiting portion engaged simultaneously with the upper and lower engaging surfaces of the web, the movement limiting portion limiting axial movement of said box pin relative to said web.

2. A separable bottom stop assembly as claimed in claim 1, wherein said web joins said front and rear walls in the middle of opposite ends of said walls, wherein the assembly further includes flanges extending from the opposite ends of said front and rear walls toward each other and wherein said flanges defining the first channel for receiving said box pin have a box pin urging portion urging the box pin to engage with the web.

3. A separable bottom stop assembly as claimed in claim 2, wherein said box pin urging portion includes rib-shaped projections formed on said flanges and bearing against the box pin.

4. A separable bottom stop assembly as claimed in claim 2, wherein said flanges are thinned in order to flex as the box pin is inserted into the first channel.

5. A separable bottom stop assembly as claimed in claim 2 or 3, wherein said flanges are thicker towards the bottom of the first channel.

6. A separable bottom stop assembly as claimed in claim 1 or 2, wherein said box pin has a cut-out on a side surface facing the web, the cut-out embracing the web.

7. A separable bottom stop assembly as claimed in claim 6, wherein said box pin abuts said flanges at a region below the lower engaging surface of the web when the box pin is inserted fully in the first channel.

8. A separable bottom stop assembly as claimed in claim 7, wherein an inner side surface of said cut-out is flat against the side surface of the web near an upper region thereof.

9. A separable bottom stop assembly for a separable slide fastener, the assembly comprising a box pin mounted on an end of a stringer, and an open box which is firmly engaged with said box pin by snap-fitting and, in use, receives an insert pin firmly attached to an end of another stringer, wherein the open box includes front and rear walls; a web joining said front and rear walls at portions intermediate of opposite ends of said front and rear walls and intermediate of opposite side edges of said front and rear walls, the web having upper and lower engaging surfaces; first flanges on one of the side edges of the front and rear walls and directed towards each other, and second flanges on another of the side edges of the front and rear walls and directed towards each other; a first channel defined by said front and rear walls, said web and said first flanges for receiving the box pin and a second channel defined by said front and rear walls, said web and said second flanges for receiving the insert pin, wherein said first flanges are spaced apart from each other and said second flanges are spaced apart from each other to allow tapes of the stringers to pass through, wherein projections are provided on the first flanges defining the first channel, wherein the box pin has on a side surface facing said web upper and lower engaging surfaces for engaging with said upper and lower engaging surfaces of said web so as to prevent axial movement of the box pin in the first channel, and wherein said box pin is so shaped that a side surface facing said first flanges bears against said projections projecting from said first flanges at a region below the lower engaging surfaces of said box pin and said web, and a side surface facing said web is brought into tight contact with said web at a region near said upper engaging surfaces of said box pin and said web.

10. A separable bottom stop assembly as claimed in claim 4, wherein said box pin abuts said flanges at a region below the lower engaging surface of the web when the box pin is inserted fully in the first channel.

11. A separable bottom stop assembly as claimed in claim 10, wherein an inner side surface of said cut-out is flat against the side surface of the web near an upper region thereof.

12. A separable bottom stop assembly as claimed in any one of claims 2 to 4, wherein said box pin abuts said flanges at a region below the lower engaging surface of the web when the box pin is inserted fully in the first channel.

13. A separable bottom stop assembly as claimed in claim 12, wherein an inner side surface of said cut-out is flat against the side surface of the web near an upper region thereof.

14. A separable bottom stop assembly as claimed in claim 6, wherein an inner side surface of said cut-out is flat against the side surface of the web near an upper region thereof.

15. A bottom stop assembly for a separable slide fastener, the assembly comprising a box pin mounted on an end of a stringer, and an open box which is firmly engaged with said box pin by snap-fitting and, in use, receives an insert pin attached to an end of another stringer, wherein the open box includes front and rear walls; a web intervening between said front and rear walls at portions intermediate of side edges of said front and rear walls, the web having upper and lower engaging surfaces; a first channel defined by said front and rear walls and said web which receives the box pin and a second channel defined by said front and rear walls and said web which receives the insert pin, wherein said box pin has a movement limiting portion engaged with the web, the movement limiting portion limiting axial movement of said box pin relative to said web, wherein said web joins said front and rear walls in the middle of opposite ends of said walls, wherein the assembly further includes flanges extending from the opposite ends of said front and rear walls toward each other and wherein said flanges defining the first channel for receiving said box pin have a box pin urging portion urging the box pin to engage with the web, wherein said box pin urging portion includes rib-shaped projections formed on said flanges and bearing against the box pin.

16. A bottom stop assembly for a separable slide fastener, the assembly comprising a box pin mounted on an end of a stringer, and an open box which is firmly engaged with said box pin by snap-fitting and, in use, receives an insert pin attached to an end of another stringer, wherein the open box includes front and rear walls; a web intervening between said front and rear walls at portions intermediate of side edges of said front and rear walls, the web having upper and lower engaging surfaces; a first channel defined by said front and rear walls and said web which receives the box pin and a second channel defined by said front and rear walls and said web which receives the insert pin, wherein said box pin has a movement limiting portion engaged with the web, the movement limiting portion limiting axial movement of said box pin relative to said web, wherein said web joins said front and rear walls in the middle of opposite ends of said walls, wherein the assembly further includes flanges extending from the opposite ends of said front and rear walls toward each other and wherein said flanges defining the first channel for receiving said box pin have a box pin urging portion urging the box pin to engage with the web, wherein said flanges are thinned in order to flex as the box pin is inserted into the first channel.

* * * * *